US008929754B2

(12) United States Patent
Nakano et al.

(10) Patent No.: US 8,929,754 B2
(45) Date of Patent: Jan. 6, 2015

(54) IMAGE FORMING APPARATUS PROVIDED WITH A WASTE TONER FULL-CAPACITY DETECTION MECHANISM

(75) Inventors: Kuniaki Nakano, Osaka (JP); Toshiki Takiguchi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 321 days.

(21) Appl. No.: 13/288,256

(22) Filed: Nov. 3, 2011

(65) Prior Publication Data

US 2012/0121280 A1 May 17, 2012

(30) Foreign Application Priority Data

Nov. 17, 2010 (JP) ..... 2010-256376

(51) Int. Cl.
*G03G 21/12* (2006.01)
*G03G 15/00* (2006.01)

(52) U.S. Cl.
CPC ..... *G03G 15/556* (2013.01); *G03G 15/553* (2013.01); *G03G 21/12* (2013.01); *G03G 2215/0132* (2013.01)
USPC ..... 399/35; 399/13; 399/360

(58) Field of Classification Search
CPC ... G03G 21/12; G03G 21/10; G03G 15/5079; G03G 15/553
USPC ..... 399/8, 13, 35, 360
See application file for complete search history.

(56) References Cited

U.S. PATENT DOCUMENTS 4,982,231 A * 1/1991 Matsuuchi ..... 399/35
2004/0260803 A1 * 12/2004 Nakamura

FOREIGN PATENT DOCUMENTS

JP 2000259054 A * 9/2000 ..... G03G 21/10
JP 2005-173451 6/2005
JP 2006-154411 6/2006
JP 2007-286299 11/2007

* cited by examiner

*Primary Examiner* — David Gray
*Assistant Examiner* — Laura Roth
(74) *Attorney, Agent, or Firm* — Nixon & Vanderhye P.C.

(57) ABSTRACT

An image forming apparatus includes a waste toner box, a base, a detection sensor, a counter and a controller. The waste toner box collects toner not transferred to a sheet but remaining on a surface of a photoreceptor. The base is for placing the waste toner box thereon, and a position of the base changes with a weight of the waste toner box placed thereon. The detection sensor detects the position of the base to detect an amount of toner in the waste toner box placed on the base. The counter counts the number of sheets with images formed thereon. The controller determines whether or not to continue image formation on a sheet on a basis of a signal from the detection sensor and the counter.

12 Claims, 10 Drawing Sheets

IMAGE FORMING APPARATUS PROVIDED WITH A WASTE TONER FULL-CAPACITY DETECTION MECHANISM

CROSS REFERENCE

This Nonprovisional application claims priority under 35 U.S.C. §119(a) on Patent Application No. 2010-256376 filed in Japan on Nov. 17, 2010, the entire contents of which are hereby incorporated by reference.

BACKGROUND OF THE INVENTION

The present invention relates to image forming apparatuses provided with a waste toner full-capacity detection mechanism.

In electrophotography image forming apparatuses, toner adhering to the surface of a photoreceptor is transferred onto a sheet, and the toner on the sheet is fixed to complete image forming process. The toner adhering to the surface of the photoreceptor is transferred to the sheet by electrical action. A part of the toner, however, remains on the photoreceptor surface, and therefore a mechanism to collect such remaining toner is needed. To this end, electrophotography image forming apparatuses are provided with a waste toner box to collect the not-transferred toner remaining on the photoreceptor surface after the image forming process and store a predetermined amount of such waste toner therein.

These image forming apparatuses are provided with a detection sensor to detect the amount of toner stored in the waste toner box. This detection sensor can detect, on the basis of the weight of the waste toner box placed on a waste toner box base, the end state where the waste toner box is full of waste toner as well as the near-end state where the waste toner box is almost full of waste toner. The near-end state is for informing a user of such a state and letting the user replace the waste toner box before the waste toner box becomes full of the waste toner because the image forming apparatus in the end state no longer can execute the image forming process.

The near-end state, however, is canceled in some cases by shaking or tapping the waste toner box in the near-end state, and repeated cancellation of the near-end state to continue the image forming process may cause waste toner to be collected more than the limit of the toner collection capacity of the waste toner box, resulting in the trouble of the overflow of waste toner from the waste toner box and so contamination of the apparatus main body.

To cope with this, a technique to prevent the overflow of waste toner from the waste toner box has been disclosed, for example in JP 2006-154411 A. According to this patent document, as the number of times of the replacement of a waste toner box increases, the number of images that can be formed after the detection of a near-end state decreases.

As stated above, the near-end state of a waste toner box is detected with a detection sensor on the basis of the weight of the waste toner box placed on a waste toner box base. Such a detection of the near-end state based on the weight detection, however, has the problem of a detection error of the near-end state repeating detection and non-detection caused by factors such as vibration of the image forming apparatus main body. Unfortunately, in such a case, a user cannot judge whether or not to replace the waste toner box.

In view of the aforementioned problems, it is an object of the present invention to provide an image forming apparatus capable of preventing a detection error of a near-end state for a waste-toner box.

SUMMARY OF THE INVENTION

An image forming apparatus of the present invention includes a waste toner box, a base, a detection sensor, a counter and a controller.

The waste toner box collects toner not transferred to a sheet but remaining on a surface of a photoreceptor. The base is for placing the waste toner box thereon, and a position of the base changes with a weight of the waste toner box placed thereon. The detection sensor detects the position of the base to detect an amount of toner in the waste toner box placed on the base. The counter counts the number of sheets with images formed thereon. The controller determines whether or not to continue image formation on a sheet on a basis of a signal from the detection sensor and the counter.

The detection sensor can detect an operable state, a near-end state and an end state of the waste toner box. In the operable state, the waste toner box is placed on the base and an amount of toner in the waste toner box is a predetermined amount or less. In the near-end state, the waste toner box is placed on the base and an amount of toner in the waste toner box is almost full capacity. In the end state, the waste toner box is placed on the base and an amount of toner in the waste toner box reaches the full capacity.

When the detection sensor detects the near-end state, the controller starts counting of a value of the counter. When the detection sensor detects the operable state during time duration before the value of the counter reaches a first predetermined value, the controller resets the counter. On the other hand, when the detection sensor continuously detects the near-end state during time duration before the value of the counter reaches the first predetermined value, the controller determines the near-end state and generates a notice signal to a user.

DETAILED DESCRIPTION OF THE INVENTION

The following is a detailed description of image forming apparatuses according to embodiments of the present invention, with reference to the drawings.

Firstly Embodiment 1 of the present invention is described below.

Figure 1:
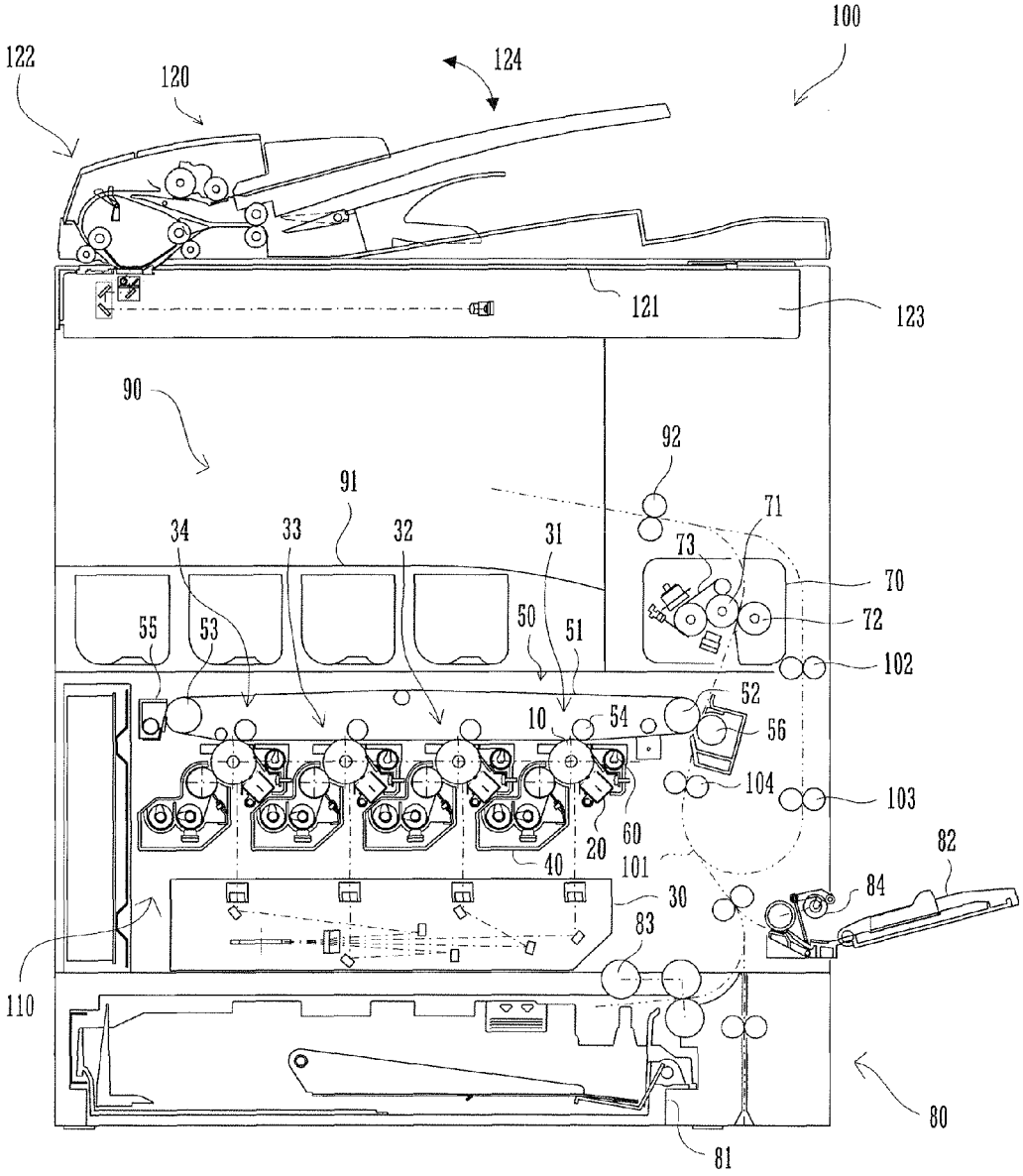
FIG. 1 illustrates a basic configuration of an image forming apparatus according to Embodiment 1 of the present invention.

FIG. 1 illustrates a basic configuration of an image forming apparatus 100 according to Embodiment 1 of the present invention.

The image forming apparatus 100 forms multicolored or single-colored images on a predetermined sheet (recording sheet) in accordance with image data externally transmitted. The image forming apparatus 100 includes a document processor 120, a paper feeding section 80, an image forming section 110 and a copy receiving section 90.

The document processor 120 includes a document platen 121, a document conveyor 122 and a document reader 123. The document platen 121 is made of transparent glass, on which a document can be placed. The document conveyor 122 conveys documents loaded on a document tray one by one. The document conveyor 122 is configured rotatably in the direction of an arrow 124 so as to leave the document platen 121 open, whereby a document can be manually placed on the document platen 121. The document reader 123 reads a document being carried along the document conveyor 122 or a document placed on the document platen 121.

The paper feeding section 80 includes a paper feeding cassette 81, a manual paper feeding cassette 82, a pickup roller 83 and a pickup roller 84. The paper feeding cassette 81 is a tray for storing regular-sized sheets. The manual paper feeding cassette 82 is a tray for placing irregular-sized sheets. The pickup roller 83 is provided in the vicinity of an end of the paper feeding cassette 81 so as to pick up sheets one by one from the paper feeding cassette 81 and supply the sheet to a sheet conveyance path 101. Similarly, the pickup roller 84 is provided in the vicinity of an end of the manual paper feeding cassette 82 so as to pick up sheets one by one from the manual paper feeding cassette 82 and supply the sheet to a sheet conveyance path 101.

The image forming section 110 includes image formation stations 31, 32, 33 and 34, an exposure unit 30, an intermediate transfer belt unit 50 and a fixing unit 70. The image formation stations 31, 32, 33 and 34 each include a photoreceptor drum 10, a charger 20, a development unit 40 and a cleaner unit 60, and correspond to color images in black (K), cyan (C), magenta (M) and yellow (Y), respectively. The present embodiment describes the image formation station 31.

The photoreceptor drum 10 to bear an image of a developer thereon rotates during image formation. Around the photoreceptor drum 10 is disposed the charger 20, the exposure unit 30, the development unit 40, the intermediate transfer belt unit 50 and the cleaner unit 60 in this order from the upstream of the rotation direction. The fixing unit 70 is positioned at the most downstream side of the image forming section 110 above the conveyance path 101.

The charger 20 is charging means to uniformly charge the surface of the photoreceptor drum 10 at a predetermined electrical potential. The charger 20 may be of a charger type as illustrated in FIG. 1, or may be a roller-shaped or a brush-shaped charger of a contact type.

The exposure unit 30 functions to exposure the charged photoreceptor drum 10 with light in accordance with image data input, thereby forming an electrostatic latent image on the surface of the photoreceptor drum 10 in accordance with the image data. The exposure unit 30 is configured as a laser scanning unit (LSU) provided with a laser emitting part, a reflective mirror and the like. In the exposure unit 30 is disposed optical elements such as a polygon mirror scanning laser light and a lens and a mirror for introducing laser light reflected from the polygon mirror to the photoreceptor drum 10. Alternatively, the exposure unit 30 may include an EL or a LED writing head with an array of light-emitting elements, for example.

The development unit 40 makes the electrostatic latent image formed on the photoreceptor drum 10 visible with toner.

The intermediate transfer belt unit 50 includes an intermediate transfer belt 51, an intermediate transfer belt driving roller 52, an intermediate transfer belt idle roller 53, intermediate transfer rollers 54, and an intermediate transfer belt cleaning unit 55.

The intermediate transfer belt driving roller 52, the intermediate transfer belt idle roller 53 and the intermediate transfer rollers 54 are configured to rotary-drive the intermediate transfer belt 51 while stretching the intermediate transfer belt 51 therebetween. The intermediate transfer roller 54 gives transfer bias to transfer a toner image on the photoreceptor drum 10 to the intermediate transfer belt 51.

The intermediate transfer belt 51 is provided to come into contact with the photoreceptor drum 10, and has a function to let a toner image formed on the photoreceptor drum 10 transferred thereon and so form a toner image thereon. The intermediate transfer belt 51 is formed as an endless belt using film of 100 μm to 150 μm in thickness, for example.

The toner image is transferred from the photoreceptor drum 10 to the intermediate transfer belt 51 by means of the intermediate transfer roller 54 coming into contact with the rear side of the intermediate transfer belt 51. In order transfer the toner image, a transfer bias of a high voltage (high voltage with reversed polarity (+) of the polarity (−) of charged toner) is applied to the intermediate transfer roller 54. The intermediate transfer roller 54 is a roller including a metal (e.g., stainless steel) shaft of 8 to 10 mm in diameter as a base that is surrounded by a conductive elastic material (e.g., EPDM or urethane foam). This conductive elastic material enables the uniform application of a high voltage to the intermediate transfer belt 51. The present embodiment uses the transfer electrodes in a roller shape, but not limited to, and brush type transfer electrodes may be used for example.

As stated above, electrostatic images made visible on the photoreceptor drums 10 are overlaid on the intermediate transfer belt 51. As the intermediate transfer belt 51 rotates, the thus overlaid image information is transferred onto a sheet by transfer roller 56 that is disposed at a contact position of the sheet and the intermediate transfer belt 51.

At this time, the intermediate transfer belt 51 and the transfer roller 56 are brought into contact with each other under pressure with a predetermined nip, while a voltage (high voltage with reversed polarity (+) of the polarity (−) of charged toner) applied to the transfer roller 56 for transferring of the toner onto a sheet. In order to allow the transfer roller 56 to achieve the above-stated nip steadily, any one of the transfer roller 56 and the intermediate transfer belt driving roller 52 may be made of a hard material (e.g., metal), and the other may be made of a soft material (e.g., elastic rubber roller or foaming resin roller) such as an elastic roller.

As stated above, toner adheres to the intermediate transfer belt 51 as a result of the contact with the photoreceptor drums 10 or toner remains on the intermediate transfer belt 51 without being transferred to a sheet by the transfer roller 56. In order to remove and collect such toner, the intermediate transfer belt cleaning unit 55 is provided. The intermediate transfer belt cleaning unit 55 is provided with a cleaning blade, for example, as a cleaning member coming into contact with the intermediate transfer belt 51, and at a portion of the intermediate transfer belt 51 coming into contact with the cleaning blade, the intermediate transfer belt 51 is supported by the intermediate transfer belt idle roller 53 from the opposite side.

The cleaner unit 60 removes and collects toner remaining on the surface of the photoreceptor drum 10 after development and image transferring process.

The fixing unit 70 includes a heat roller 71 and a pressure roller 72. The heat roller 71 and the pressure roller 72 rotate while sandwiching a sheet therebetween. The heat roller 71 is set at a predetermined fixing temperature by a controller on the basis of a signal from a temperature detector not illustrated. The heat roller 71 as well as the pressure roller 72 have a function to heat and pressurize toner to a sheet to melt, mix and pressurize a toner image transferred on the sheet for heat fixing. An external heating belt 73 is provided to heat the heat roller 71 externally.

The copy receiving section 90 includes a copy receiving tray 91 and exit rollers 92. A sheet passing through the fixing unit 70 is discharged to the copy receiving tray 91 via the exit rollers 92. The copy receiving tray 91 is a tray for collecting printed sheets.

In the case of a double-sided printing request, a sheet subjected to single-sided printing as stated above and passing through the fixing unit 70 is held at its rear end by the exit rollers 92. Thereafter, the exit rollers 92 rotate reversely and guide the sheet to conveyance rollers 102 and 103. Then, the sheet passes through paper stop rollers 104 and printing is performed on the rear face of the sheet, and the sheet is discharged to the copy receiving tray 91.

Figure 2:
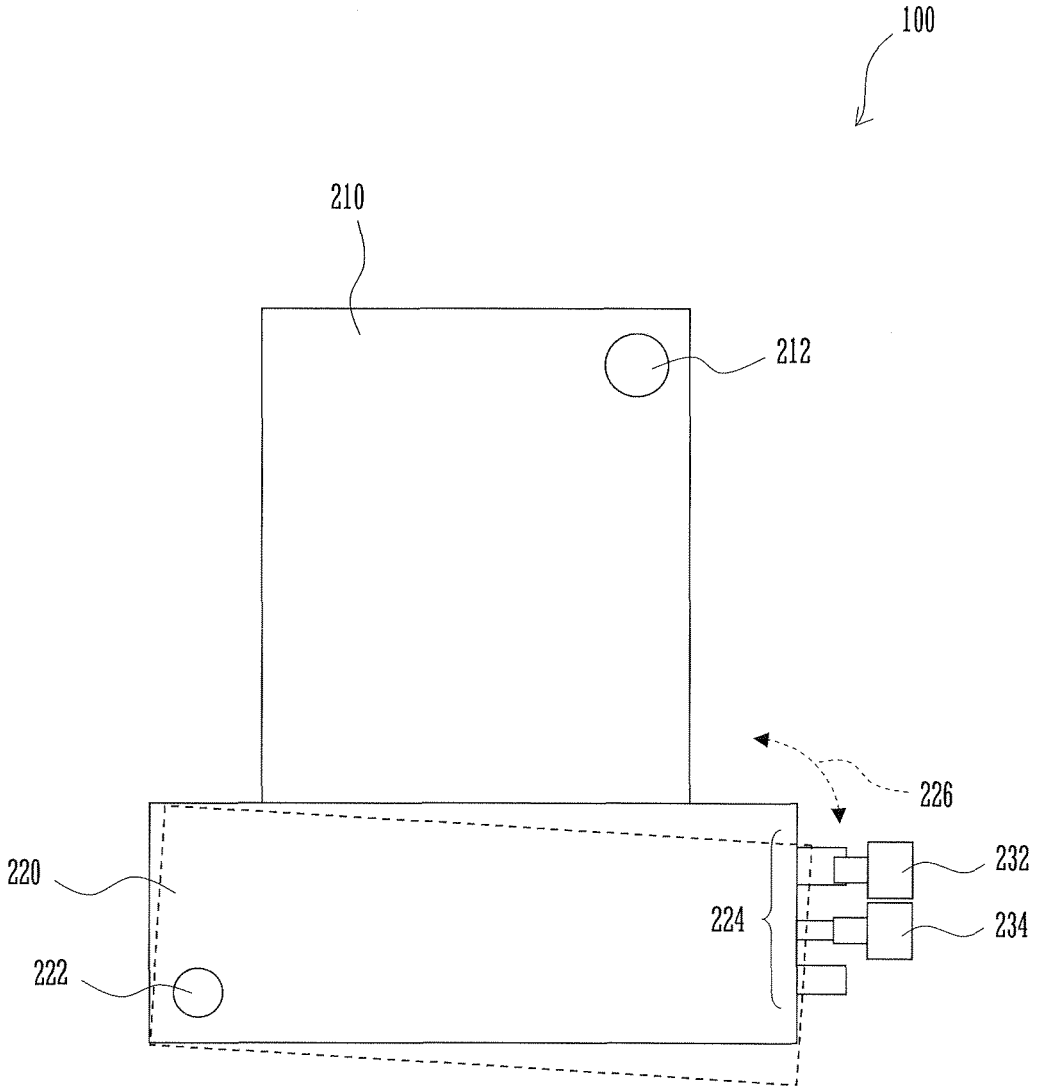
FIG. 2 illustrates a toner amount detection mechanism in a waste toner box provided in the image forming apparatus according to Embodiment 1 of the present invention.

FIG. 2 illustrates a toner amount detection mechanism in a waste toner box 210 provided in the image forming apparatus 100 according to Embodiment 1 of the present invention.

The image forming apparatus 100 includes the waste toner box 210, a base 220 and detection sensors 232 and 234. The waste toner box 210 has a waste toner injection slot 212. The base 220 has a fulcrum shaft 222 and protrusions 224.

The waste toner box 210 is a box to collect toner not transferred to a sheet but remaining on the surface of the photoreceptor drums 10. The waste toner injection slot 212 is an inlet to let waste toner conveyed via screws or the like from the cleaner unit 60 into the waste toner box 210.

The base 220 is for placing the waste toner box 210 thereon. The position of the base 220 changes about the fulcrum shaft 222. That is, the base 220 can sway about the fulcrum shaft 222 in the direction of an arrow 226. The base 220 is supported by an elastic member such as a compression spring on the opposite side of the fulcrum shaft 222 (the side of the protrusions 224 in FIG. 2). Accordingly, the position of the base 220 changes with the weight of the waste toner box 210 placed thereon. Since the present embodiment is provided with a stopper structure to limit the position change range of the base 220, the position of the base 220 can change only in a predetermined range.

The detection sensors 232 and 234 detect the position of the base 220, thus detecting the amount of toner in the waste toner box 210 placed on the base 220. More specifically, the base 220 is displaced downward as the weight of the waste toner box 210 placed thereon increases. The detection sensors 232 and 234 detect the position of the protrusions 224 of the base 220, whereby the amount of toner in the waste toner box can be detected. The present embodiment use reflective sensors for the detection sensors 232 and 234, but not limited to. They may be transmissive sensors or contact-type sensors, for example.

Figure 3:
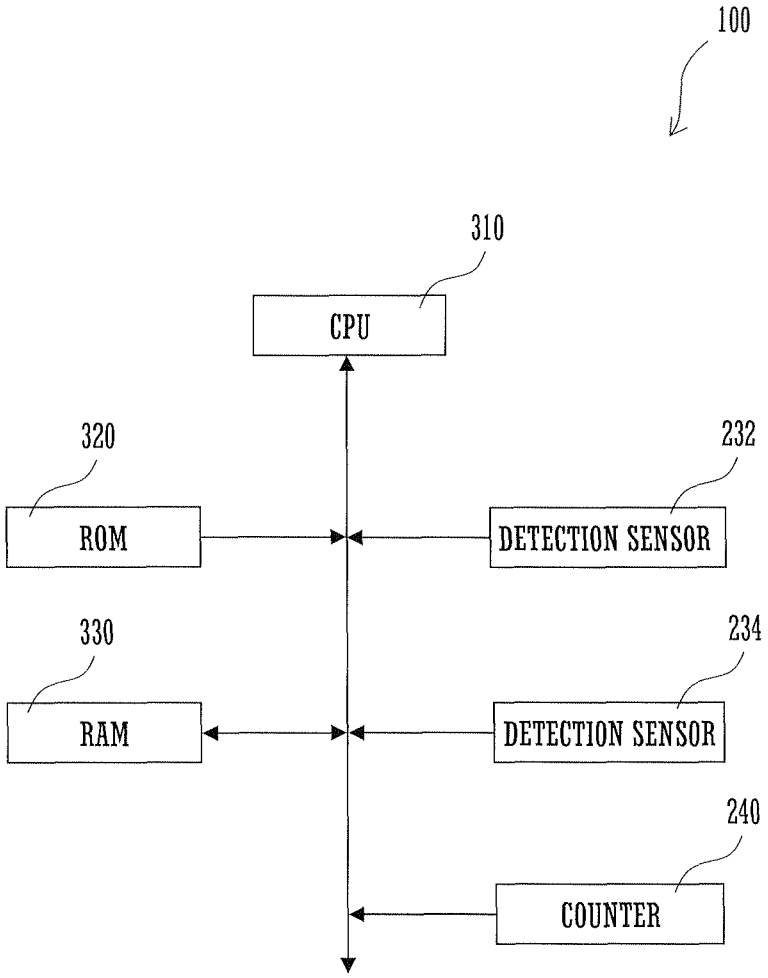
FIG. 3 is a block diagram illustrating the major part of a control mechanism in the image forming apparatus according to Embodiment 1 of the present invention.

FIG. 3 is a block diagram illustrating the major part of a control mechanism in the image forming apparatus 100 according to Embodiment 1 of the present invention.

The image forming apparatus 100 includes a CPU 310, a ROM 320, a RAM 330, the detection sensors 232 and 234 and a counter 240. The CPU 310 corresponds to a controller of the present invention.

The CPU 310 reads a program recorded in the ROM 320 for execution to control various parts as a whole. The counter 240 counts the number of sheets with images formed thereon. The CPU 310 determines whether or not to continue sheet image formation on the basis of signals from the detection sensors 232 and 234 and the counter 240.

In the present embodiment, the detection sensors 232 and 234 can detect four states of the waste toner box 210. That is, the detection sensors 232 and 234 can detect the four states including a not-placed state where the waste toner box 210 is not placed on the base 220; an operable state where the waste toner box 210 is placed on the base 220 and the amount of toner in the waste toner box 210 is a predetermined amount or less; a near-end state where the waste toner box 210 is placed on the base 220 and the amount of toner in the waste toner box 210 is almost the full capacity; and an end state where the waste toner box 210 is placed on the base 220 and the amount of toner in the waste toner box 210 reaches the full capacity.

Further, when the detection sensors 232 and 234 detect the near-end state, the CPU 310 starts counting of the value of the counter 240. When the detection sensors 232 and 234 detect the operable state during time duration before the value of the counter 240 reaches a first predetermined value, the CPU 310 resets the counter 240. On the other hand, when the detection sensors 232 and 234 continuously detect the near-end state during time duration before the value of the counter 240 reaches the first predetermined value, the CPU 310 determines the near-end state and generates a notice signal to a user. In the present embodiment, the first predetermined value is set at 200. Of course, the first predetermined value may be any value.

According to this configuration, even when the detection sensors 232 and 234 detect the near-end state, the CPU 310 does not determine immediately the near-end state. Instead, when the detection sensors 232 and 234 continuously detect the near-end state while a predetermined number of sheets of images are formed, the CPU 310 determines the near-end state. Therefore, a detection error of the near-end state for the waste toner box 210 can be prevented.

FIGS. 4A to 4D illustrate the four detection states for the waste toner box 210 provided in the image forming apparatus 100 according to Embodiment 1 of the present invention.

Figure 4A:
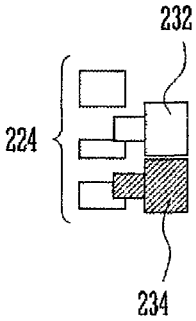
FIGS. 4A to 4D illustrate four detection states for a waste toner box provided in the image forming apparatus according to Embodiment 1 of the present invention.
Figure 4B:
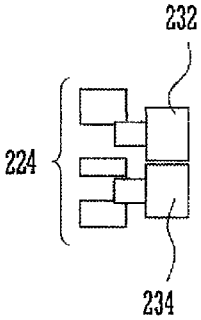

FIG. 4A illustrates a state where the detection sensor 234 reacts because a protrusion 224 reflects light emitted from the detection sensor 234. In this state, the base 220 is located at the uppermost position. That is, the waste toner box 210 is in the not-placed state where the waste toner box 210 is not correctly placed on the base 220.

FIG. 48 illustrates a state where neither of the detection sensors 232 and 234 reacts because the protrusions 224 are located at positions not reflecting light emitted from the detection sensors 232 and 234. In this state, the base 220 is located below the base 220 in the not-placed state. That is, the waste toner box 210 is correctly placed on the base 220 and the amount of toner in the waste toner box 210 is a predetermined amount or less, and so the waste toner box 210 is in an operable state.

Figure 4C:
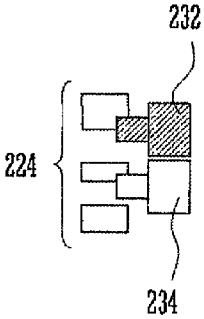

FIG. 4C illustrates a state where the detection sensor 232 reacts because a protrusion 224 reflects light emitted from the detection sensor 232. In this state, the base 220 is located below the base 220 in the operable state. That is, the waste toner box 210 is correctly placed on the base 220 and in the near-end state where the amount of toner in the waste toner box 210 is close to the full capacity.

Figure 4D:
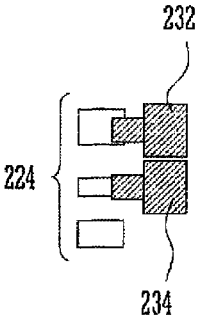

FIG. 4D illustrates a state where both of the detection sensors 232 and 234 react because the protrusions 224 reflect light emitted from the detection sensors 232 and 234. In this state, the base 220 is located at the lowermost position. That is, the waste toner box 210 is correctly placed on the base 220, and the waste toner box 210 is in the end state full of toner.

Figure 5:
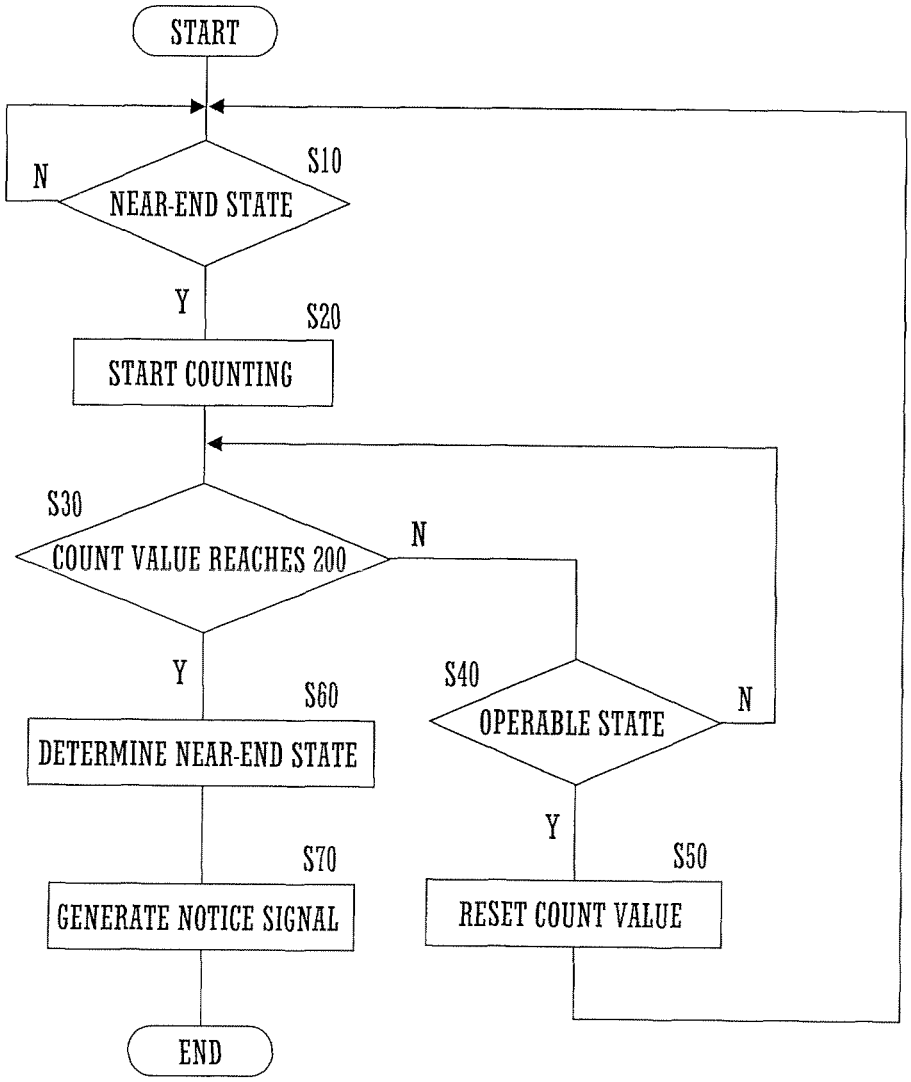
FIG. 5 is a flowchart describing the way to control the image forming apparatus according to Embodiment 1 of the present invention.
Figure 6:
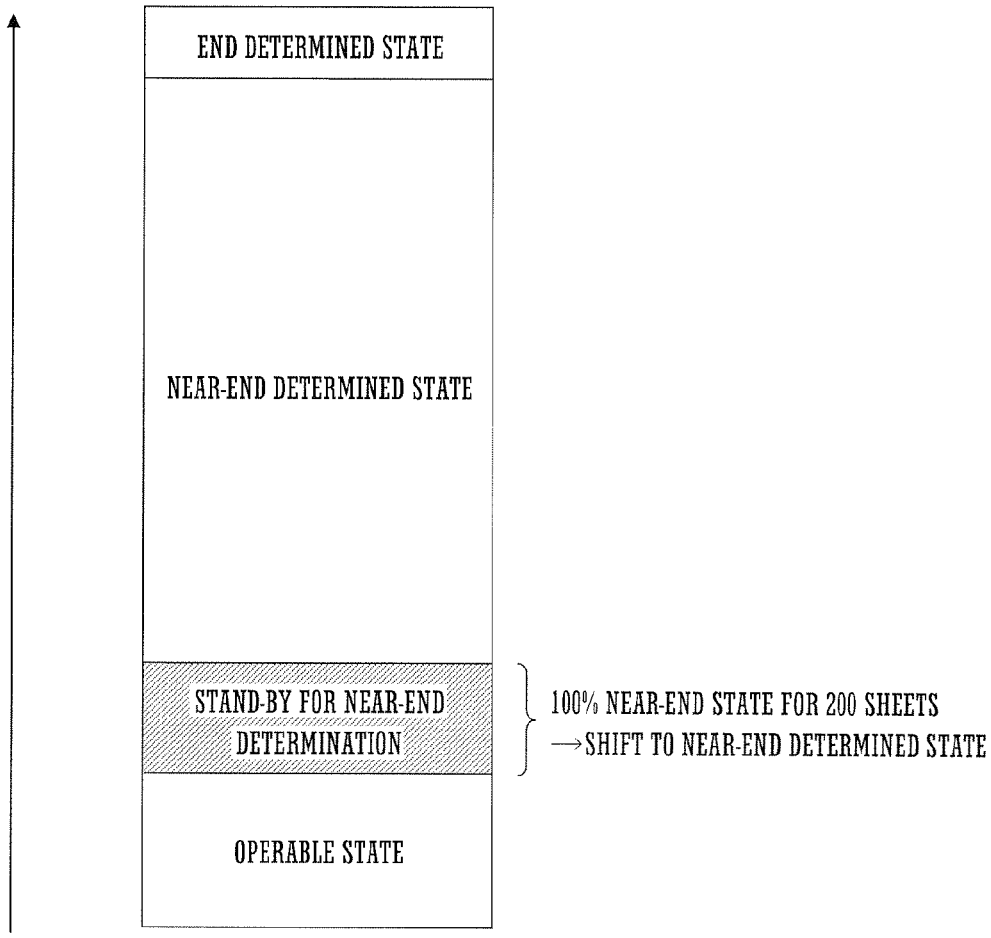
FIG. 6 illustrates detection states by detection sensors of the image forming apparatus according to Embodiment 1 of the present invention.

FIG. 5 is a flowchart describing the way to control the image forming apparatus 100 according to Embodiment 1 of the present invention. FIG. 6 illustrates the detection states by the detection sensors 232 and 234 of the image forming apparatus 100 according to Embodiment 1 of the present invention.

This flowchart describes the control related to Embodiment 1 of the present invention only. The CPU 310 stands by until the detection sensors 232 and 234 detect the near-end state (N at S10). This state corresponds to the operable state of FIG. 6. When the CPU 310 determines that the detection sensors 232 and 234 detect the near-end state (Y at S10), the CPU 310 starts counting of the counter 240 (S20). This state corresponds to the stand-by for near-end determination of FIG. 6.

The CPU 310 determines whether the value of the counter 240 is reaches 200 or not (S30). When the CPU 310 determines that the value of the counter 240 does not reach 200 (N at S30), the CPU 310 determines whether the detection sensors 232 and 234 detect the operable state or not (S40). When the CPU 310 determines that the detection sensors 232 and 234 do not detect the operable state (N at S40), the CPU 310 shifts to the determination at S30. When the CPU 310 determines that the detection sensors 232 and 234 detect the operable state (Y at S40), the CPU 310 resets the counter 240 (S50) and shifts to the determination at S10.

When the CPU 310 determines that the value of the counter 240 reaches 200 (Y at S30), the CPU 310 determines the near-end state (S60) and generates a notice signal to a user (S70). This state corresponds to the near-end determined state of FIG. 6.

In the present embodiment and other embodiments described later, when the CPU 310 determines the near-end state, the CPU 310 issues a signal with FSS to a service company replacing the waste toner box 210.

According to this control, even when the detection sensors 232 and 234 detect the near-end state, the CPU 310 does not determine immediately the near-end state. Instead, when the detection sensors 232 and 234 continuously detect the near-end state while a predetermined number of sheets of images are formed, the CPU 310 determines the near-end state. Therefore, a detection error of the near-end state for the waste toner box 210 can be prevented.

Next, the following describes Embodiment 2 of the present invention. In the following description of embodiments, the description of the part common to Embodiment 1 has been omitted to avoid duplication.

Figure 7:
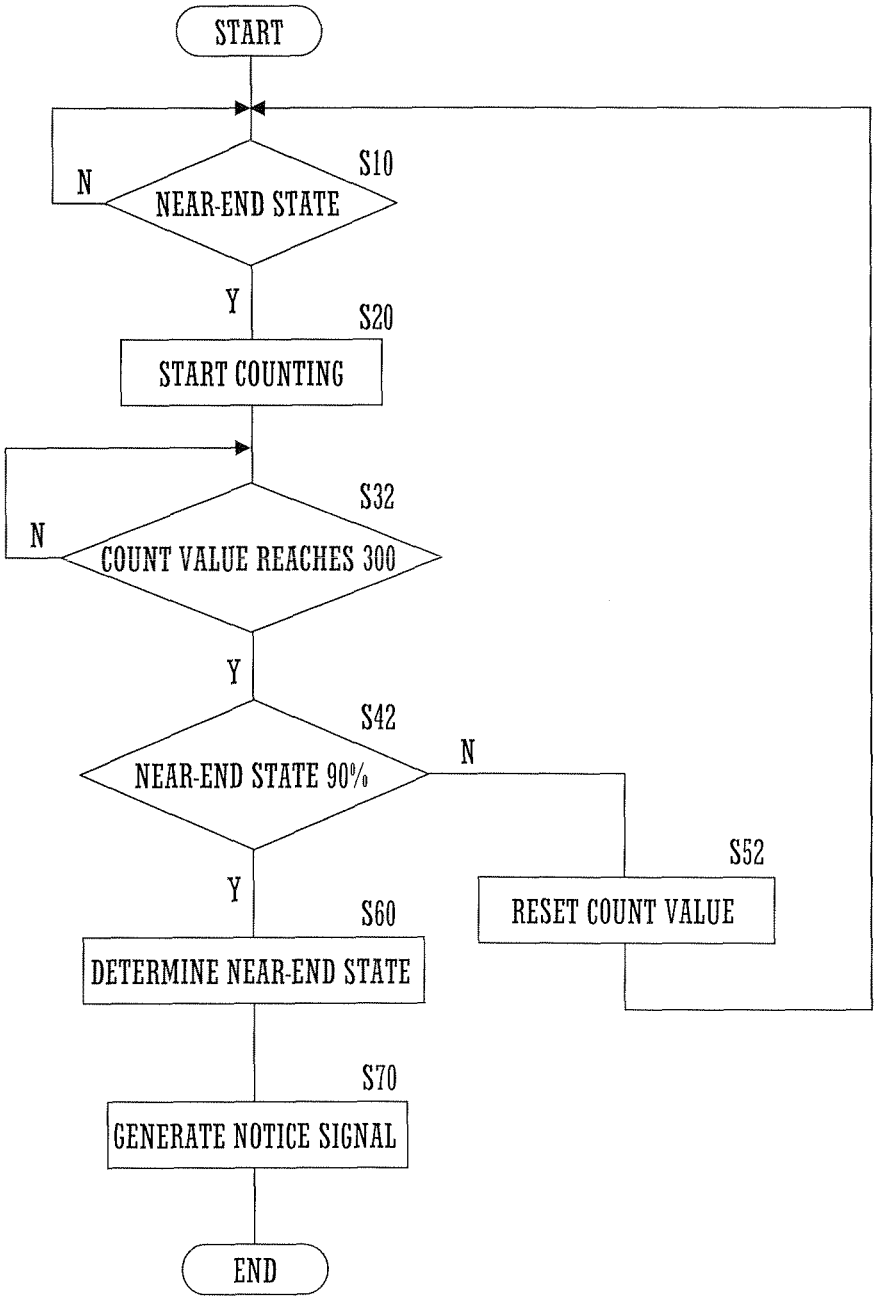
FIG. 7 is a flowchart describing the way to control an image forming apparatus according to Embodiment 2 of the present invention.
Figure 8:
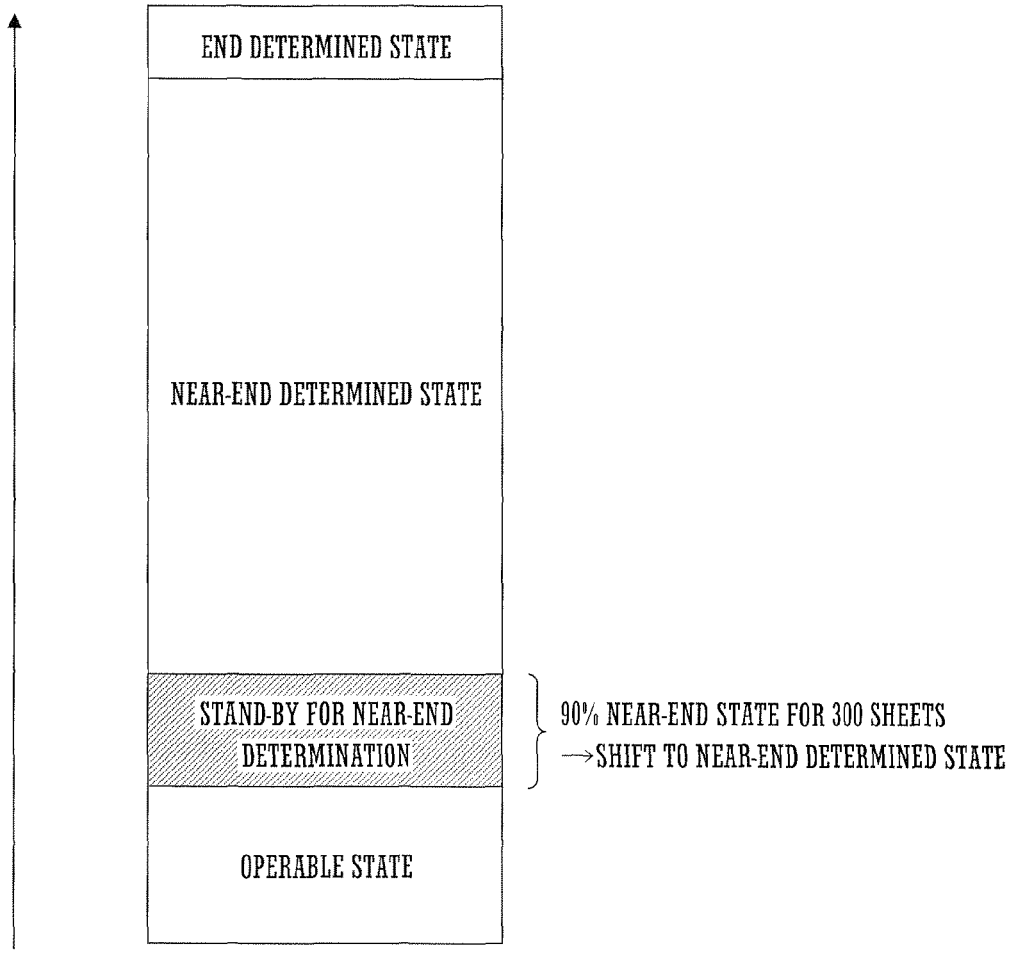
FIG. 8 illustrates detection states by detection sensors of the image forming apparatus according to Embodiment 2 of the present invention.

FIG. 7 is a flowchart describing the way to control an image forming apparatus 100 according to Embodiment 2 of the present invention. FIG. 8 illustrates detection states by detection sensors 232 and 234 of the image forming apparatus 100 according to Embodiment 2 of the present invention.

In the present embodiment, when the detection sensors 232 and 234 detect the near-end state, a CPU 310 starts counting of the value of a counter 240. When the detection sensors 232 and 234 detect the operable state during time duration before the value of the counter 240 reaches a second predetermined value, the CPU 310 resets the counter 240. On the other hand, when the detection sensors 232 and 234 detect the near-end state a predetermined ratio or more during time duration before the value of the counter 240 reaches the second predetermined value, the CPU 310 determines the near-end state and generates a notice signal to a user.

In the present embodiment, the second predetermined value is set at 300. Of course, the second predetermined value may be any value. The predetermined ratio in the present embodiment is set at 90%. Of course, the predetermined ratio may be any value.

After the CPU 310 starts counting of the counter 240 (S20), the CPU 310 determines whether the value of the counter 240 reaches 300 or not (S32). When the CPU 310 determines that the value of the counter 240 does not reach 300 (N at S32), the CPU 310 stands by until the value reaches 300. This state corresponds to the stand-by for near-end determination of FIG. 8.

When the CPU 310 determines that the value of the counter 240 reaches 300 (Y at S32), the CPU 310 determines whether the detection sensors 232 and 234 detect the near-end state 90% or more of the duration before the value of the counter 240 reaches 300 (S42). When the CPU 310 determines that the detection sensors 232 and 234 do not detect the near-end state 90% or more (N at S42), the CPU 310 resets the counter 240 (S52) and shifts to the determination at S10.

When the CPU 310 determines that the detection sensors 232 and 234 detect the near-end state 90% or more (Y at S42), the CPU 310 determines the near-end state (S60) and generates a notice signal to a user (S70). This state corresponds to the near-end determined state of FIG. 8.

According to this control, even when the detection sensors 232 and 234 detect the near-end state, the CPU 310 does not determine immediately the near-end state. Instead, when the detection sensors 232 and 234 detect the near-end state a predetermined ratio or more while a predetermined number of sheets of images are formed, the CPU 310 determines the near-end state. Therefore, a detection error of the near-end state for the waste toner box 210 can be prevented.

Next, the following describes Embodiment 3 of the present invention.

Figure 9:
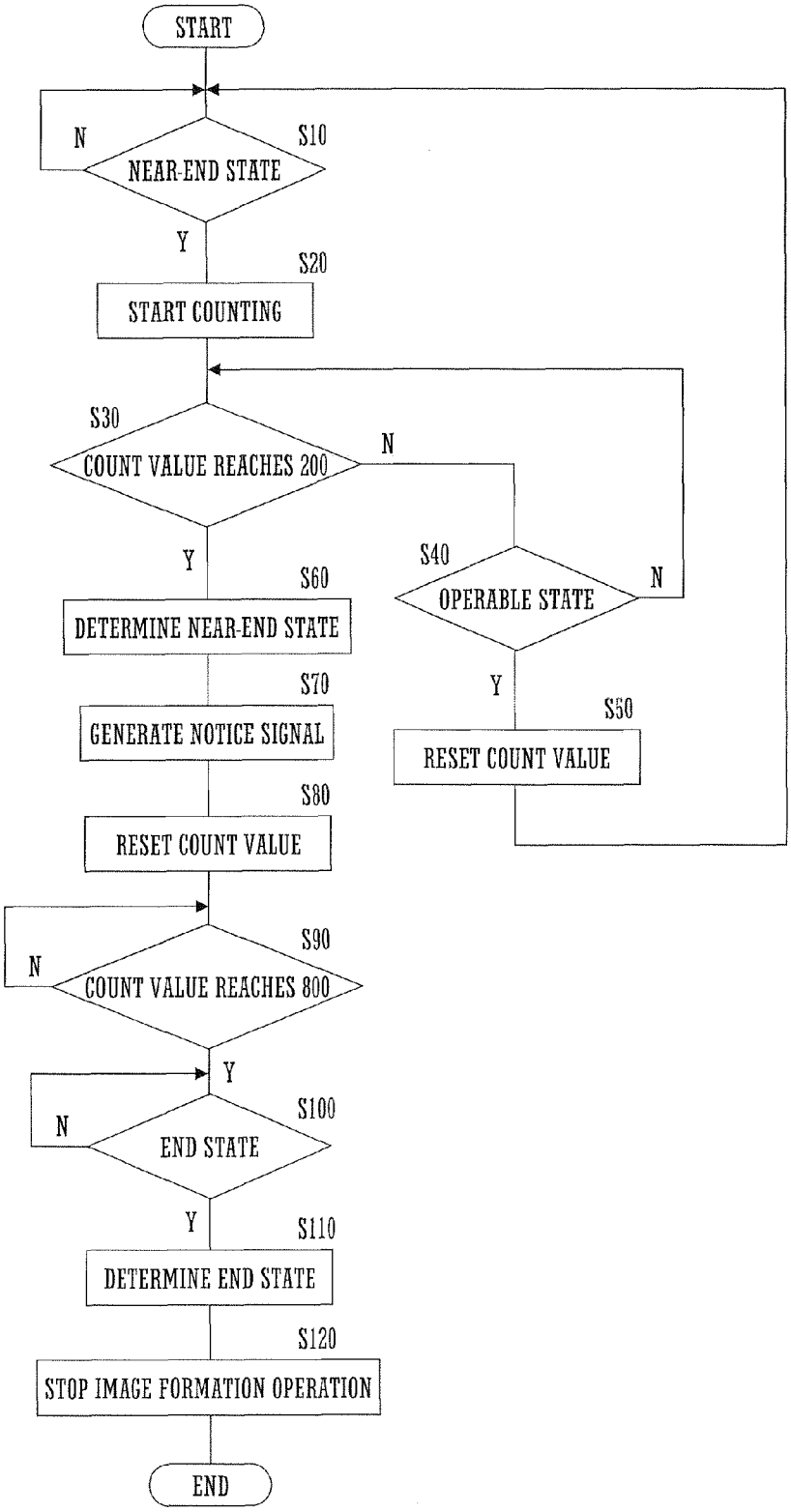
FIG. 9 is a flowchart describing the way to control an image forming apparatus according to Embodiment 3 of the present invention.

FIG. 9 is a flowchart describing the way to control an image forming apparatus 100 according to Embodiment 3 of the present invention.

In the present embodiment, when a CPU 310 determines the near-end state, the CPU 310 resets a counter 240 and then restarts counting of the counter 240. Thereafter when the value of the counter 240 reaches a third predetermined value and when detection sensors 232 and 234 detect the end state, the CPU 310 determines the end state and stops the image formation operation. In the present embodiment, the third predetermined value is set at 800. Of course, the third predetermined value may be any value.

This flowchart describes the control related to Embodiment 3 of the present invention only. The steps from S10 to S70 have been already described for Embodiment 1, and therefore the description thereof is omitted.

Following S70, the CPU 310 resets the counter 240 (S80). At this time, since the counter 240 is just reset and keeps counting the number of sheets of images formed. Thereafter, the CPU 310 determines whether the value of the counter 240 reaches 800 or not (S90). When the CPU 310 determines that the value of the counter 240 does not reach 800 (N at S90), the CPU 310 stands by until the value of the counter 240 reaches 800.

When the CPU 310 determines that the value of the counter 240 reaches 800 (Y at S90), the CPU 310 determines whether the detection sensors 232 and 234 detect the end state or not (S100). When the CPU 310 determines that the detection sensors 232 and 234 do not detect the end state (N at S100), the CPU 310 stands by until the detection sensors 232 and 234 detect the end state. When the CPU 310 determines that the detection sensors 232 and 234 detect the end state (Y at S100), the CPU 310 determines the end state (S110) and stops the image formation operation (S120). This state corresponds to the end determined state of FIG. 6.

In the present embodiment and other embodiments described later, when the CPU 310 determines the end state, the CPU 310 issues a signal with FSS to a service company replacing the waste toner box 210.

According to this control, the CPU 310 does not determine the end state before the value of the counter 240 reaches the third predetermined value and the detection sensors 232 and 234 detect the end state. Accordingly, a detection error of the end state for the waste toner box 210 can be prevented.

Note here that, although the determination at S90 is prior to the determination at S100 in the present embodiment, the order thereof is not limited to this. S100 in the flowchart may be prior to S90.

Finally, the following describes Embodiment 4 of the present invention.

Figure 10:
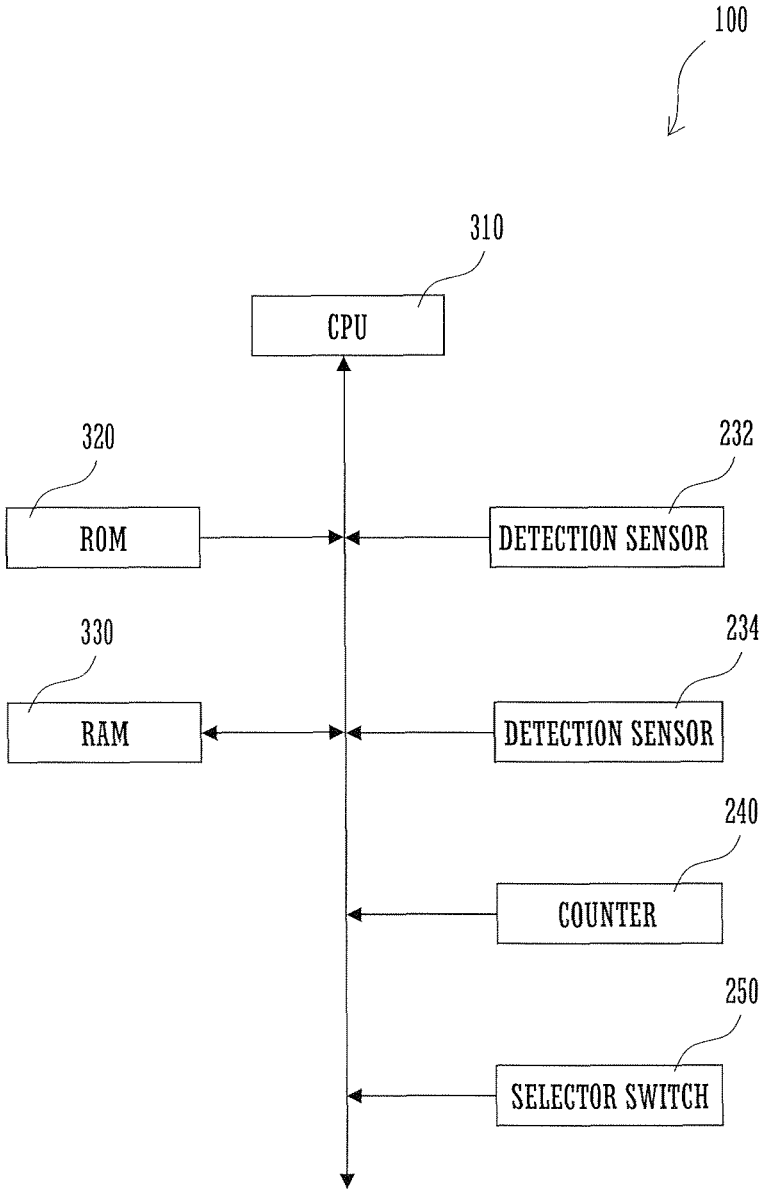
FIG. 10 is a block diagram illustrating the major part of a control mechanism in an image forming apparatus according to Embodiment 4 of the present invention.

FIG. 10 is a block diagram illustrating the major part of a control mechanism in an image forming apparatus 100 according to Embodiment 4 of the present invention.

The image forming apparatus 100 is further provided with a selector switch 250. The selector switch 250 switches between valid and invalid of a notice signal generated by a CPU 310.

In this configuration, a notice signal generated at S70 of the flowcharts shown in FIGS. 5, 7 and 9 can be switched as to whether the signal is to be reported to a user or not. Therefore, when a user wants to know the amount of toner in the waste toner box 210, the user is allowed to switch the selector switch 250 so as to report the notice signal to the user. On the other hand, when a user does not want to care about the amount of toner in the waste toner box 210, the selector switch 250 can be switched so as not to report the notice signal to the user.

Embodiments 1 to 4 described so far are not independent of each other, and so they can be combined freely.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. An image forming apparatus, comprising:

a waste toner box that collects toner not transferred to a sheet but remaining on a surface of a photoreceptor;

a base for placing the waste toner box thereon, a position of the base changing with a weight of the waste toner box placed thereon;

a detection sensor that detects the position of the base to detect an amount of toner in the waste toner box placed on the base;

a counter that counts the number of sheets with images formed thereon; and a controller that determines whether or not to continue image formation on a sheet on a basis of a signal from the detection sensor and the counter;

wherein the detection sensor can detect an operable state, a near-end state and an end state of the waste toner box, the operable state where the waste toner box is placed on the base and an amount of toner in the waste toner box is a predetermined amount or less, the near-end state where the waste toner box is placed on the base and an amount of toner in the waste toner box is almost full capacity and the end state where the waste toner box is placed on the base and an amount of toner in the waste toner box reaches the full capacity, and when the detection sensor detects the near-end state, the controller starts counting of a value of the counter, when the detection sensor detects the operable state during a time duration before the value of the counter reaches a first predetermined value, the controller resets the counter without determining the near-end state and without generating a notice signal to a user, and only when the detection sensor continuously detects the near-end state during a time period that elapses while the counter is counting and until the value of the counter reaches the first predetermined value, the controller determines the near-end state and generates the notice signal to a user.

2. The image forming apparatus according to claim 1, wherein when the controller determines the near-end state, the controller resets the counter and then restarts counting of the value of the counter, and thereafter when the value of the counter reaches a second predetermined value and the detection sensor detects the end state, the controller determines the end state and stops image formation operation.

3. The image forming apparatus according to claim 2, wherein when the controller determines the end state, the controller issues a predetermined signal to a service company replacing the waste toner box.

4. The image forming apparatus according to claim 1, further comprising a selector switch that switches between valid and invalid of a notice signal generated by the controller.

5. The image forming apparatus according to claim 1, wherein the detection sensor further detects a not-placed state where the waste toner box is not placed on the base.

6. The image forming apparatus according to claim 1, wherein when the controller determines the near-end state, the controller issues a predetermined signal to a service company replacing the waste toner box.

7. An image forming apparatus, comprising:

a waste toner box that collects toner not transferred to a sheet but remaining on a surface of a photoreceptor;

a base for placing the waste toner box thereon, a position of the base changing with a weight of the waste toner box placed thereon;

a detection sensor that detects the position of the base to detect an amount of toner in the waste toner box placed on the base;

a counter that counts the number of sheets with images formed thereon; and a controller that determines whether or not to continue image formation on a sheet on a basis of a signal from the detection sensor and the counter;

wherein the detection sensor can detect an operable state, a near-end state and an end state of the waste toner box, the operable state where the waste toner box is placed on the base and an amount of toner in the waste toner box is a predetermined amount or less, the near-end state where the waste toner box is placed on the base and an amount of toner in the waste toner box is almost full capacity and the end state where the waste toner box is placed on the base and an amount of toner in the waste toner box reaches the full capacity, and when the detection sensor detects the near-end state, the controller starts counting of a value of the counter, when the detection sensor detects the near-end state for a predetermined ratio or more of the time period that elapsed while the counter was counting and until the counter reached the first predetermined value, the controller determines the near-end state and generates a notice signal to a user, and wherein if the detection sensor did not detect the near-end state for the predetermined ratio or more of the time period that elapsed while the counter was counting and until the counter reached the first predetermined value, the controller resets the counter without determining the near-end state and without generating a notice signal to the user.

8. The image forming apparatus according to claim 7, wherein when the controller determines the near-end state, the controller resets the counter and then restarts counting of the value of the counter, and thereafter when the value of the counter reaches a second predetermined value and the detection sensor detects the end state, the controller determines the end state and stops image formation operation.

9. The image forming apparatus according to claim 8, wherein when the controller determines the end state, the controller issues a predetermined signal to a service company replacing the waste toner box.

10. The image forming apparatus according to claim 7, further comprising a selector switch that switches between valid and invalid of a notice signal generated by the controller.

11. The image forming apparatus according to claim 7, wherein the detection sensor further detects a not-placed state where the waste toner box is not placed on the base.

12. The image forming apparatus according to claim 7, wherein when the controller determines the near-end state, the controller issues a predetermined signal to a service company replacing the waste toner box.

* * * * *